United States Patent [19]

Brown

[11] 3,940,088

[45] Feb. 24, 1976

[54] COILED-LINE PAY OFF METHOD AND APPARATUS

[75] Inventor: Trenton L. Brown, Bethel Park, Pa.

[73] Assignee: Aluminum Company of America, Pittsburgh, Pa.

[22] Filed: June 19, 1974

[21] Appl. No.: 480,731

[52] U.S. Cl. ..... 242/128; 242/47.11; 242/54 R

[51] Int. Cl.[2] ..... B65H 49/00

[58] Field of Search ..... 242/47.01, 47.03, 47.11, 242/76, 83, 128, 129.8, 54 R, 157 R; 226/92; 19/159 R; 140/124, 34, 47, 63

[56] References Cited

UNITED STATES PATENTS

| | | | |
|---|---|---|---|
| 1,206,563 | 11/1916 | McConnell | 242/107 R |
| 3,337,154 | 8/1967 | Smith, Jr. et al. | 242/83 |

*Primary Examiner*—Leonard D. Christian

*Attorney, Agent, or Firm*—Daniel A. Sullivan, Jr.

[57] ABSTRACT

A method of feeding coiled line to an operation at a rate matching that at which the operation can accommodate the line, including the steps of situating a lead coil of the line on a spiral table, sensing the diameter of the lead coil on the table, and rotating the coiled line to pay off line to the operation, the rotating being increased or decreased in response to decreases or increases in the lead coil diameter sensed in the step of sensing, wherein the improvement comprises turning the spiral table against the lead coil to situate the lead coil on the spiral table.

An apparatus including a spiral table and means for sensing the diameter of a lead coil on the table, wherein the improvement comprises means for rotating the table about its axis.

2 Claims, 7 Drawing Figures

COILED-LINE PAY OFF METHOD AND APPARATUS

FIELD OF THE INVENTION

The present invention relates to method and apparatus for controlled-velocity pay off of coiled line to an operation, for instance the pay off of coiled tubing to a tube drawing machine.

SUMMARY OF THE INVENTION

It is an object of the present invention to facilitate lead-coil-diameter sensing for feed rate control of the pay off of coiled line.

This as well as other objects which will become apparent in the discussion that follows are achieved, according to the present invention, by providing a method of feeding coiled line to an operation at a rate matching that at which the operation can accommodate the line, including the steps of situating a lead coil of the line on a spiral table, sensing the diameter of the lead coil on the table, and rotating the coiled line to pay off line to the operation, the rotating being increased or decreased in response to decreases or increases in the lead coil diameter sensed in the step of sensing, wherein the improvement comprises turning the spiral table against the lead coil to situate the lead coil on the spiral table; and an apparatus including a spiral table and means for sensing the diameter of a lead coil on the table, wherein the improvement comprises means for rotating the table about its axis.

DESCRIPTION OF THE PREFERRED EMBODIMENTS

Figure 1:
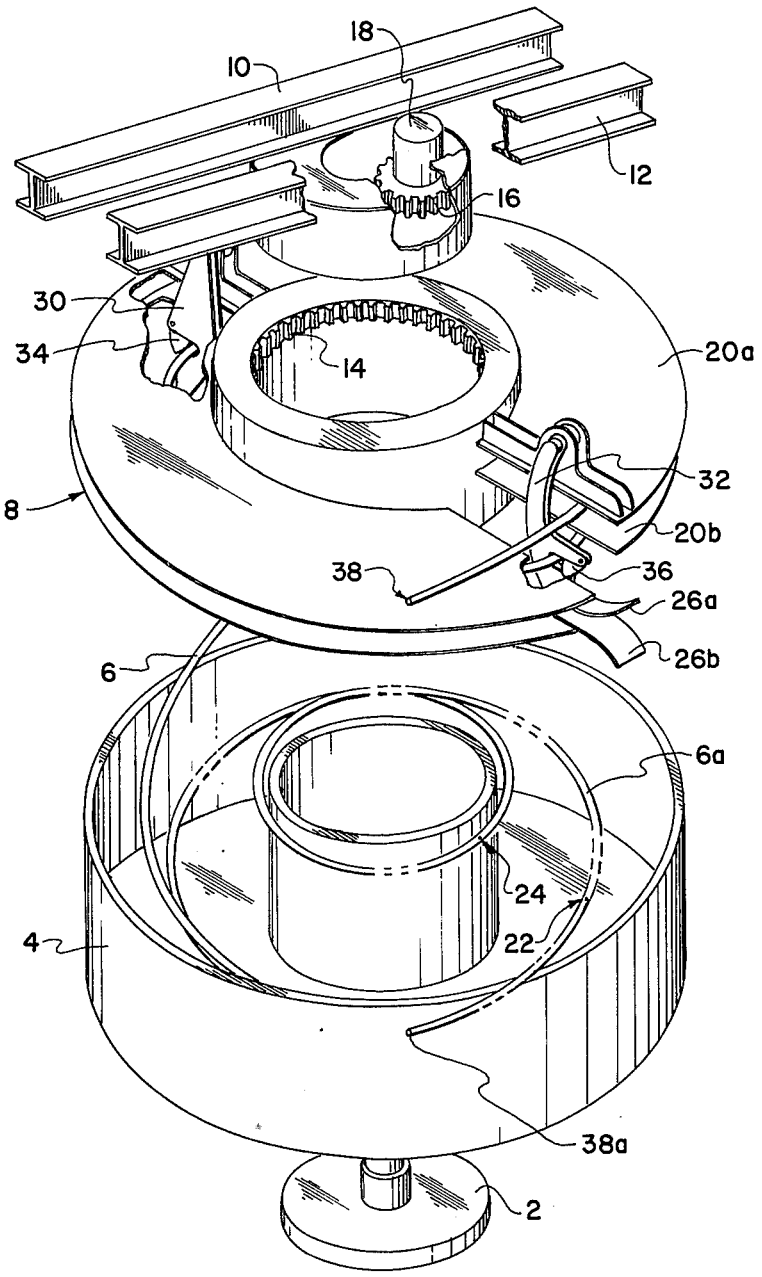
FIG. 1 is a perspective, exploded view of an apparatus suitable for practicing the method of the present invention and containing apparatus features of the present invention.

Referring first to FIG. 1, there is illustrated an apparatus for carrying out the method of the present invention. The apparatus includes a motor driven pay off 2, whose motor is of the variable speed type. To be placed on this pay off and capable of being rotated by it is a basket 4. This basket contains coiled line, for example coiled tubing, which is to be submitted to, for example, a drawing operation. Line 6 is illustrated coming out of the basket 4. The position of this line before it has been situated on spiral table 8 is illustrated by the dashed representation 6*a*.

The spiral table 8 is arranged above the basket 4 on pay off 2. Its support means is illustrated schematically by I-beams 10 and 12. According to the apparatus portion of the present invention, the spiral table 8 is capable of rotation about its axis. This capability is provided for example by means of the internally-toothed ring gear 14, fixed to the spiral table, and drive pinion 16, which engages the teeth of gear 14. The drive pinion 16 is powered by drive motor 18.

The spiral table 8 includes a top spiral surface 20*a* and a bottom spiral surface 20*b* forming a ramp. These spiral surfaces are spaced from one another to form a spiral channel for accommodating a convolution of a lead coil of the coiled line during its situation on the spiral table.

The lead coil of the coiled line in the basket extends approximately between point 22 and point 24 on the line as illustrated by dashed representation 6*a*.

Figure 2A:
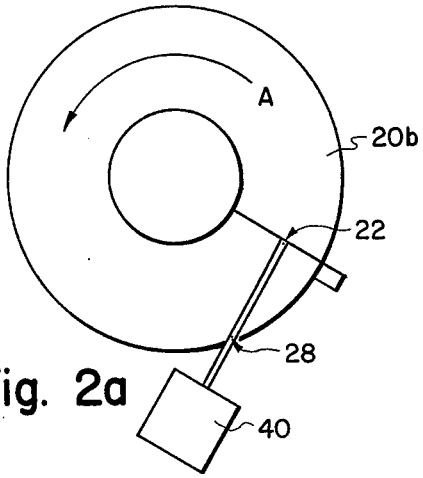
FIGS. 2*a* to 2*e* are schematic views downwards onto the surface 20*b* of FIG. 1.
Figure 2B:
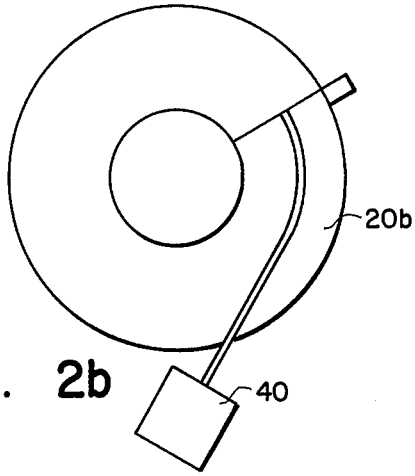
Figure 2C:
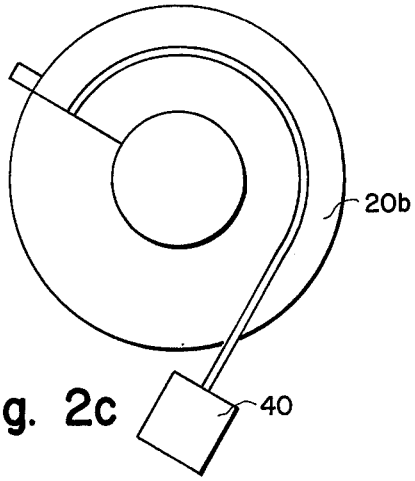
Figure 2D:
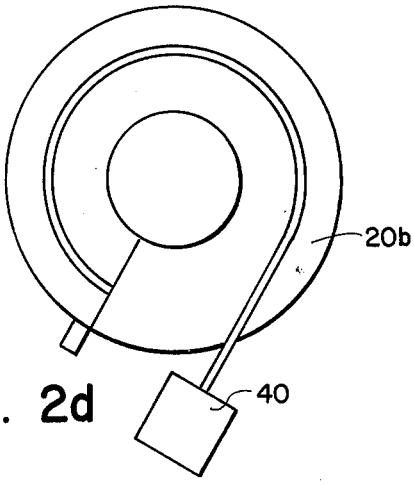
Figure 2E:
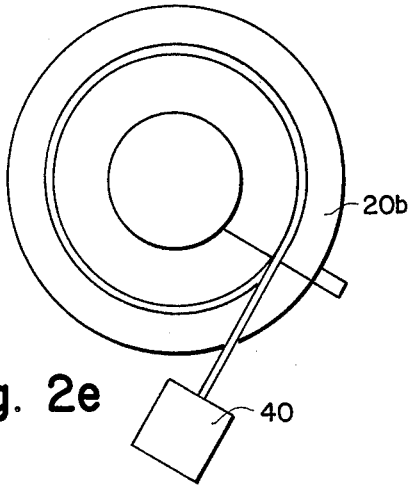

According to an example of the method of the invention, in order to situate this lead coil on the spiral table 8, the line is lifted approximately at point 22 and pushed between pickup arms 26*a* and 26*b*, so that the portion of the line between points 28 and 22 comes to lie on surface 20*b* in FIG. 2*a*. Then, the spiral table is rotated in the counterclockwise direction A of FIG. 2*a* by starting drive motor 18. The spiral table rotates 360° of arc, between its position shown in FIG. 2*a* and its position in FIG. 2*e*, with intermediate positions being illustrated in FIGS. 2*b* through 2*d*. The increasing amounts of the lead coil which become situated on the spiral table 8, in particular the surface 20*b*, as the table rotates the 360° are shown by the sequence of figures, FIGS. 2*a* through 2*e*.

With the lead coil situated on spiral table 8, it is held on reactor arm 30 and counterbalance arm 32 with the help of latches 34 and 36.

The line leaving the spiral table 8 is shown broken off at points 38 and 38*a* in FIg. 1. Thus, the line may already be inserted into a draw block, for instance the draw block 40 illustrated schematically in FIGS. 2*a* through 2*e*. Somewhat more detail about a possible exemplification of draw block 40 is shown by, for example, drawing die 14 and drum 16 in FIG. 1 of U.S. Pat. No. 3,337,154 issued Aug. 22, 1967 to F. J. Smith, Jr. et al. for a "Motor Control System for Coiling Apparatus". However, it need only be recognized for purposes of the present description that line 6 may be subjected to, for example, a drawing operation during which the line is being pulled through a drawing die by pulling means operating independently of the motor-driven pay off 2, and it is desired to pay off line 6 from basket 4 by rotating basket 4 at a rotational speed yielding a pay off of the line 6 in basket 4 at a velocity matching the rate at which the line is being accommodated by the drawing operation.

An alternative to the present invention would be to have a workman grasp the lead end of a coiled line in basket 4 and push it between the pickup arms 26*a* and 26*b* and then walk the lead end all the way around the spiral table 8, with the spiral table 8 remaining stationary, and in this way obtain a situating of the lead coil of the coiled line on the spiral table. A particular advantage of the present invention is that it enables the situating of the lead coil on the spiral table even after the lead end of a coiled line has already been inserted into a drawing block. For example, a drawing operation may have proceeded long enough that the end of a coiled line in a basket 4 is being approached, the line end finally passing out of the basket and then out of the spiral table. The draw block operation is then stopped, so that the line end has still not gone through the draw block and is thus protruding out of the draw block. It is then possible to move the old, empty basket 4 out from between the motordriven pay off 2 and the spiral table 8 and to bring in a new basket 4 containing a full load of coiled line. The lead end of the coiled line may be welded to the trailing end of the previously drawn line, with the resulting continuous line being then situated, as above described, on spiral table 8 by a lifting of point 22 into the area between pickup arms 26*a* and 26*b*, with an ensuing rotation of the spiral table through 360°.

Figure 3:
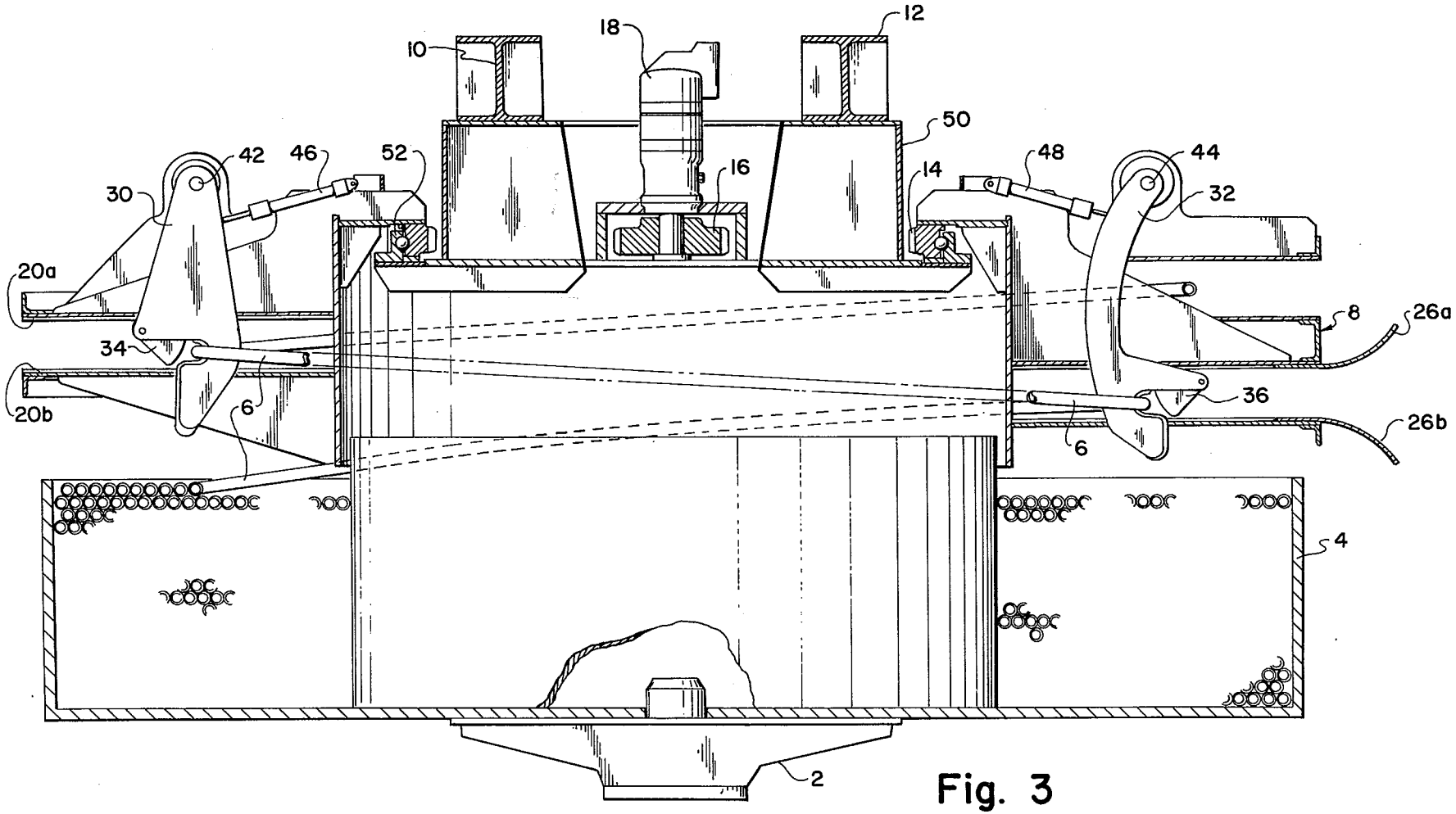
FIG. 3 is an elevational cross section of the assembled apparatus of FIG. 1 and includes the axis of the apparatus.

As illustrated particularly in FIG. 3, both the reactor arm 30 and the counterbalance arm 32 are pivotably mounted at points 42 and 44, respectively. The swinging of either arm out of its null position is accompanied by the contracting or extending of air springs 46 and 48. While arm 32 is present just to provide a counterbalance against arm 30, the movement of arm 30 out of the null position in either direction is utilized for controlling the rotational speed of the variable speed motor in pay off 2. Thus, an increasing in the diameter of the lead coil swings arm 30 outwards from the axis of the spiral table and is indicative of the fact that the line is being fed to the drawing operation at a rate faster than the line can be there accommodated. Appropriate means are provided to slow down the motor drive of pay off 2 when outward rotation of arm 30 about pivot 42 occurs. If the drawing operation is processing the line at a rate faster than it is being paid off from basket 4, then the lead coil is reduced in diameter, this causing a swinging of arm 30 about pivot point 42 inwards towards the axis of the spiral table 8. This inward swinging of arm 30 must cause the speed up of the motor in pay off 2. An appropriate system for utilizing the pivoting of arm 30 to change the motor speed in pay off 2 is shown in the above mentioned U.S. Pat. No. 3,337,154 (arm 47 of that patent corresponding essentially to arm 30 of the present drawings) and is not reproduced here, since the present invention is directed primarily toward the particular improvement of utilizing a rotation of spiral table 8 for the purpose of obtaining an automatic situating of the lead coil of the coiled line onto spiral table 8.

After the trailing end of a line has passed out of the spiral table 8, it is the preferred practice of the present invention to rotate the spiral table 8 360° backwards, in the clockwise direction with reference to FIG. 2*a*, so that the table is ready for another automatic situating of the lead coil of the coiled line in a new basket. This practice of rotating the table backwards through 360° has the advantage of making it unnecessary to provide means for preventing the twisting-up of whatever auxiliary lines, such as electrical or hydraulic lines, might be brought into table 8.

Further with reference to FIG. 3, certain portions of the apparatus for practicing the method of the present invention are illustrated in greater detail. This figure illustrates, in particular, how the exploded portions of FIG. 1 are pieced together. During operation, the pay off table 2, whose axis is aligned with the axis of the spiral table 8, holds the basket 4 consequently in axial alignment with the spiral table 8. There is no connection between basket 4 and spiral table 8, other than that loosely resulting from the fact that line 6 extends between the basket 4 and the spiral table 8. The spiral table 8 is supported from the support beams 10 and 12. In the particular embodiment illustrated, this is accomplished by the welding or bolting of stationary support 50 to the bottom of beams 10 and 12. Stationary support 50 carries the drive pinion 16 and motor 18 unit; although appearing centered in FIG. 3, this unit is offset into the depth of FIG. 3 to bring the pinion into meshing engagement with ring gear 14.

Ring gear 14 is provided in the illustrated embodiment as part of a ball bearing. Ring gear 14 forms the moving bearing race of the bearing. The fixed bearing race 52 is secured to the stationary support 50. The framework of spiral table 8 is bolted to the upper side of ring gear 14. In this way, it is possible to use the drive pinion 16 and drive motor 18 unit for rotating the spiral table 8 360° with respect to stationary support 50.

It will be understood that the above description of the present invention is susceptible to various modifications, changes and adaptations and the same are intended to be comprehended within the meaning and range of equivalence of the appended claims.

What is claimed is:

1. A method of feeding coiled line to an operation at a rate matching that at which the operation can accommodate the line, including the steps of situating a lead coil of the line on a spiral table, sensing the diameter of the lead coil on the table, and rotating the coiled line to pay off line to the operation, the rotating being increased or decreased in response to decreases or increases in the lead coil diameter sensed in the step of sensing, wherein the improvement comprises turning the spiral table against the lead coil for accomplishing said step of situating the lead coil on the spiral table.

2. An apparatus including (1) a spiral table comprising ramp means for supporting a convolution of a lead coil, (2) means for sensing the diameter of said convolution of lead coil on the table, and (3) a pay off table whose axis is aligned with the axis of the spiral table and whose rotational speed is controlled by the means for sensing, wherein the improvement comprises means for rotating the spiral table about its axis.

* * * * *